US012133593B2

(12) United States Patent
Yang

(10) Patent No.: US 12,133,593 B2
(45) Date of Patent: Nov. 5, 2024

(54) RETRACTABLE DRAWER DIVIDING DEVICE

(71) Applicant: FUJIAN EASTWEST LIFEWIT TECHNOLOGY CO., LTD, Fuzhou (CN)

(72) Inventor: Jingui Yang, Fuzhou (CN)

(73) Assignee: FUJIAN EASTWEST LIFEWIT TECHNOLOGY CO., LTD, Fuzhou (CN)

( * ) Notice: Subject to any disclaimer, the term of this patent is extended or adjusted under 35 U.S.C. 154(b) by 0 days.

(21) Appl. No.: 18/544,308

(22) Filed: Dec. 18, 2023

(65) Prior Publication Data

US 2024/0324773 A1 Oct. 3, 2024

(30) Foreign Application Priority Data

Mar. 29, 2023 (CN) ..... 202320646978.X

(51) Int. Cl.
*A47B 88/975* (2017.01)

(52) U.S. Cl.
CPC ..... *A47B 88/975* (2017.01)

(58) Field of Classification Search
CPC ..... A47B 88/975
USPC ..... 312/348.3
See application file for complete search history.

(56) References Cited

U.S. PATENT DOCUMENTS

| | | | | | |
|---|---|---|---|---|---|
| 1,849,024 | A * | 3/1932 | Mckee | A47B 88/969 | 220/551 |
| 4,964,528 | A * | 10/1990 | Wagoner | F25D 23/069 | 62/457.2 |
| 5,803,276 | A * | 9/1998 | Vogler | A47F 5/005 | 211/184 |
| 6,991,307 | B2 * | 1/2006 | Hoenig | A47B 88/994 | 312/348.3 |
| D596,431 | S * | 7/2009 | Berger | D6/706 | |
| 7,645,001 | B2 * | 1/2010 | Harris | A47B 96/025 | 312/205 |
| 9,261,304 | B2 * | 2/2016 | Tunzi | F25D 25/00 | |
| 9,549,623 | B1 * | 1/2017 | Snell | A47B 88/975 | |
| 10,219,623 | B1 * | 3/2019 | Dibdin | A47F 5/005 | |
| 2021/0341215 | A1 * | 11/2021 | Kang | A47B 57/585 | |

* cited by examiner

*Primary Examiner* — James O Hansen

(57) ABSTRACT

The present disclosure discloses a retractable drawer dividing device, including a dividing body and a movable plate. The dividing body is a rectangular shell and internally provided with a retractable chamber extending to both ends along a length direction of the dividing body, and one end of the movable plate is slidably inserted into the retractable chamber from one end of the dividing body. A stopper mechanism is provided between the dividing body and the movable plate for limiting the sliding of the movable plate in the retractable chamber. A buffer mechanism is provided at the other end of the dividing body and configured to cushion a force applied on an inner wall of an installation site by the dividing body during installation. The retractable drawer dividing device of the present solution is used for partitioning the internal space of drawers and cabinets to increase the internal storage space.

8 Claims, 5 Drawing Sheets

RETRACTABLE DRAWER DIVIDING DEVICE

TECHNICAL FIELD

The present disclosure relates to the technical field of partition devices, and specifically to a retractable drawer dividing device.

BACKGROUND

Currently, most cabinets, houseware, household appliances, and the like are internally equipped with drawers or drawer-like components which are specifically for receiving items. In daily use, different items are often placed in the same drawer, causing disorder inside the drawer. It may be troublesome when an item needs to be taken out, the space inside the drawer cannot be used reasonably, and the drawer is gradually stored with more items, thus creating chaos. Therefore, an auxiliary tool is required to effectively divide the space inside a drawer, which is called a drawer dividing device.

For example, a retractable drawer divider disclosed by the Chinese patent application with the publication number of CN108968450A includes a main dividing body and an auxiliary dividing body that is slidably matched with the main dividing body. The main dividing body has a chamber extending along its length direction, and one end of the auxiliary dividing body extends into the chamber and slidably fits with the chamber. A stopper structure is arranged between the main dividing body and the auxiliary dividing body to limit the relative movement of the two when they move toward each other to a predetermined position. The stopper structure is located inside the chamber, resulting in difficulty in its installation, manufacturing, and maintenance.

Therefore, to solve the above-mentioned problem, the present disclosure needs to provide a drawer dividing device that is easy for production and use and has simple structure and reusable property.

SUMMARY

In view of the prior art, the present disclosure aims at providing a drawer dividing device involving easy installation and reasonable structure.

To achieve the above objective, the present disclosure provides the following technical solutions.

A retractable drawer dividing device includes a dividing body and a movable plate.

The dividing body is a rectangular shell and internally provided with a retractable chamber extending to both ends along the length direction of the dividing body. One end of the movable plate is slidably inserted into the retractable chamber from one end of the dividing body. A stopper mechanism is provided between the dividing body and the movable plate for limiting the sliding of the movable plate in the retractable chamber. A buffer mechanism is provided at the other end of the dividing body and configured to cushion a force applied on the inner wall of an installation site by the dividing body during installation.

Further, the stopper mechanism includes a locking member and a limiting structure. The limiting structure is provided on the movable plate along the length direction of the movable plate. The locking member is hinged in the retractable chamber and configured to cooperate with the limiting structure to stop the movable plate.

Specifically, the locking member and the limiting structure have a first state in which they cooperate with each other to lock the movable plate and a second state in which they are separated from each other to unlock the movable plate.

Further, the limiting structure is a rack provided on one side of the movable plate along the length direction of the movable plate. The locking member is hinged in the retractable chamber through a rotating shaft and located on the same side of the movable plate where the rack is provided.

One end of the locking member is provided with a locking block that matches the rack, and the other end of the locking member extends in a direction close to the side wall of the dividing body and is provided with a pressing block. The dividing body is provided with a window at a position corresponding to the pressing block for exposing the pressing block.

Further, the side of the pressing block adjacent to the retractable chamber is provided with a retainer capable of elastic deformation. The retainer is connected to the dividing body and used to facilitate the cooperation between the locking block and the rack to maintain the movable plate in the first state, and meanwhile, the retainer deforms by pressing the pressing block, so that the locking block is separated from the rack to switch the movable plate from the first state to the second state.

Further, the retainer is a torsion spring. The torsion spring is coaxially arranged with the rotating shaft, one end of the torsion spring abuts against the pressing block, and the other end of the torsion spring abuts against a first baffle that is arranged inside the retractable chamber.

Further, the buffer mechanism includes a sliding member, a buffer pad, and an elastic member. One end of the sliding member is slidably inserted into the retractable chamber from the side of the dividing body away from the movable plate. The elastic member is provided at the end of the sliding member adjacent to the retractable chamber, and the elastic member is used to cushion the sliding member. The buffer pad is provided on the side of the sliding member away from the retractable chamber.

Further, the side of the sliding member adjacent to the retractable chamber is provided with a hook block which is matched with a limiting block arranged inside the retractable chamber. The cooperation between the hook block and the limiting block allows the sliding member to move always within the retractable chamber.

Further, the elastic member is a spring, and the number of the spring is two. The two springs are respectively provided at both ends of the side of the sliding member adjacent to the retractable chamber. One end of the spring abuts against the sliding member, and the other end of the spring abuts against a second baffle that is arranged inside the retractable chamber.

Further, the other end of the movable plate is provided with the buffer pad.

Further, the dividing body includes a first housing and a second housing that are matched with and connected to each other. The first housing and the second housing are enclosed to form the retractable chamber. Opposite sides of the first housing and the second housing are provided with guide blocks, respectively. The movable plate is provided with guide grooves at positions corresponding to the guide blocks, and the guide grooves are configured to cooperate with the guide blocks to guide the movable plate to slide along the length direction of the dividing body.

Compared with the prior art, the present disclosure has the following advantages due to the use of the above technical solutions.

The drawer dividing device of the present solution is composed of the dividing body and the movable plate. The dividing body and the movable plate can slide relative to each other, and their lengths can be changed, thus being suitable for drawers of various sizes and structures. The stopper mechanism plays a limiting role in preventing the relative sliding between the dividing body and the movable plate. The buffer mechanism effectively prevents the dividing body and the movable plate from being bent due to excessive large force applied on the inner wall of the drawer. The buffer pad is in frictional contact with the inner wall of the drawer, leading to good connection stability and high reliability. Moreover, the connection stability will not be reduced after repeated connection, and the service life is long.

BRIEF DESCRIPTION OF THE DRAWINGS

In order to more clearly illustrate the technical solutions of the embodiments of the present disclosure, the drawings required for describing the embodiments will be briefly introduced below. Obviously, the drawings described below are only some embodiments of the present disclosure. For those of ordinary skill in the art, other drawings can also be obtained based on these drawings without creative efforts.

DETAILED DESCRIPTION OF THE EMBODIMENTS

Figure 1:
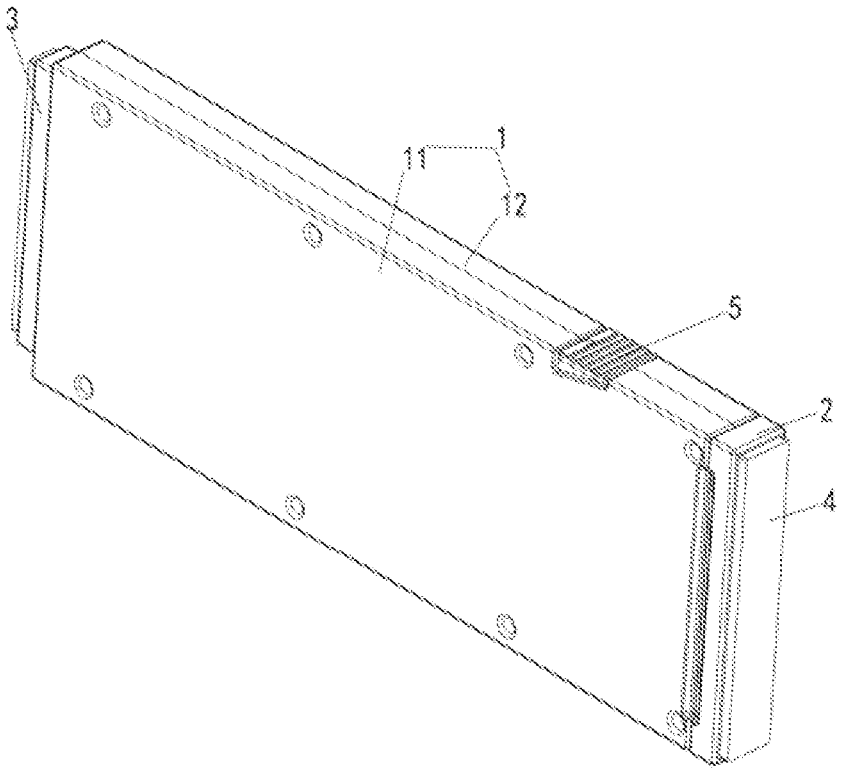
FIG. 1 is a schematic diagram showing the overall structure of the drawer dividing device of the present disclosure.

The technical solutions in the embodiments of the present disclosure will be clearly and completely described below with reference to the accompanying drawings in the embodiments of the present disclosure. Obviously, the described embodiments are only part of the embodiments of the present disclosure, rather than all embodiments. Based on the embodiments of the present disclosure, all other embodiments obtained by those of ordinary skill in the art without creative efforts fall within the scope of protection of the present disclosure.

As shown in one of FIGS. 1-7, the present solution provides a retractable drawer dividing device, which includes a dividing body 1 and a movable plate 2 that are slidably connected to each other. The dividing body 1 and the movable plate 2 extend along respective length directions. The dividing body 1 is internally provided with a retractable chamber 6 extending along the length direction of the dividing body 1, and one end of the movable plate 2 is configured to be inserted into the retractable chamber 6 and slidably matched with the retractable chamber 6.

Referring to FIGS. 2, 4, 5, 6, and 7, the retractable drawer dividing device includes the dividing body 1 and the movable plate 2.

The dividing body 1 is a rectangular shell and internally provided with the retractable chamber 6 extending to both ends along the length direction of the dividing body 1. One end of the movable plate 2 is slidably inserted into the retractable chamber 6 from one end of the dividing body 1. A stopper mechanism 5 is provided between the dividing body 1 and the movable plate 2 for limiting the sliding of the movable plate 2 in the retractable chamber 6. A buffer mechanism 3 is provided at the other end of the dividing body 1 and configured to cushion a force applied on the inner wall of an installation site by the dividing body 1 during installation.

Figure 2:
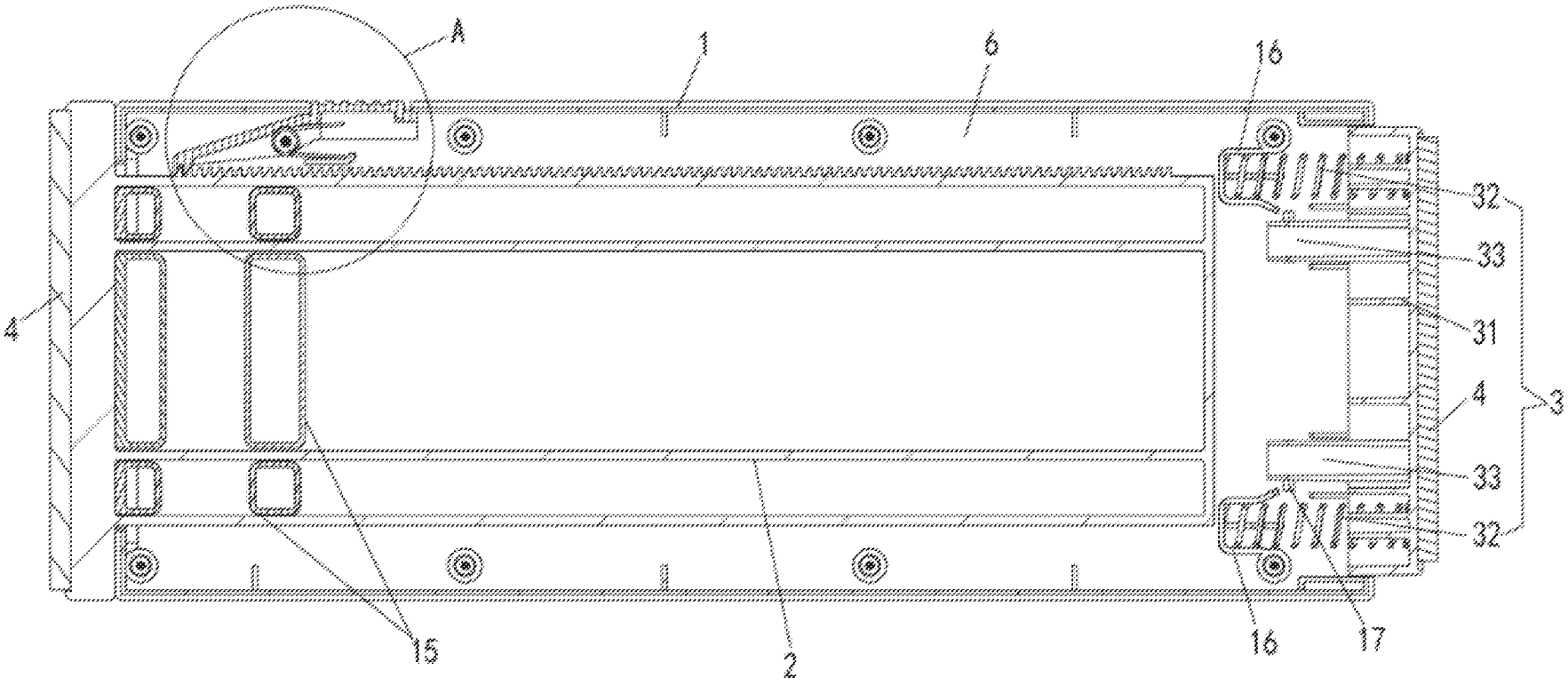
FIG. 2 is a schematic diagram showing the internal structure of the drawer dividing device of the present disclosure.

Through the above arrangement, the dividing body 1 and the movable plate 2 adopt a guide structure achieved by the cooperation between the two, as shown in FIG. 2, so that the dividing body 1 and the movable plate 2 can always be stretched along respective length directions.

In the present solution, one end of the movable plate 2 is inserted into the retractable chamber 6, and the cross section of the retractable chamber 6 along its length direction matches the cross section of the movable plate 2 along its length direction, so that the dividing body 1 and the movable plate 2 can always be stretched along respective length directions. Moreover, the drawer dividing device is retractable within a certain length and can abut against any board of a drawer. As such, the length of the drawer dividing device can be adjusted according to the length or width of the drawer, and can also be horizontally or vertically arranged as needed, thus showing a wide applicability. Division boards are installed according to actual needs, such that the space inside the drawer can be reasonably and effectively partitioned to adapt to individual use demands.

In addition, contact ends of the dividing body 1 and the movable plate 2 are both provided with installation grooves 21, and each of the installation grooves 21 is internally equipped with a buffer pad 4 made of silicone materials. The side of the buffer pad 4 that contacts the inner wall of the drawer has an uneven mesh structure, which is configured to increase the friction of the anti-slip pad 1, effectively preventing the drawer dividing device from shaking or shifting driven by items inside when the inner wall of the drawer is smooth.

Referring to FIGS. 1, 4, 5, 6, and 7, the dividing body 1 includes a first housing 11 and a second housing 12 that are matched with and connected to each other, and the retractable chamber 6 is formed between the first housing 11 and the second housing 12 and penetrates the length direction of the dividing body 1. The first housing 11 and the second housing 12 are enclosed to form the retractable chamber 6. Opposite sides of the first housing 11 and the second housing 12 are provided with guide blocks 15, respectively. The movable plate 2 is provided with guide grooves 22 at positions corresponding to the guide blocks 15, and the guide grooves 22 are configured to cooperate with the guide blocks 15 to guide the movable plate 2 to slide along the length direction of the dividing body 1.

Specifically, the first housing 11 and the second housing 12 are arranged symmetrically and adjacent to each other. Windows 13, first baffles 14, limiting blocks 17, and second baffles 16 that are located in the retractable chamber 6 each are arranged symmetrically on the first housing 11 and the second housing 12, greatly reducing the processing and design difficulty of the dividing body 1, thereby effectively reducing the processing cost of the drawer dividing device.

Figure 3:
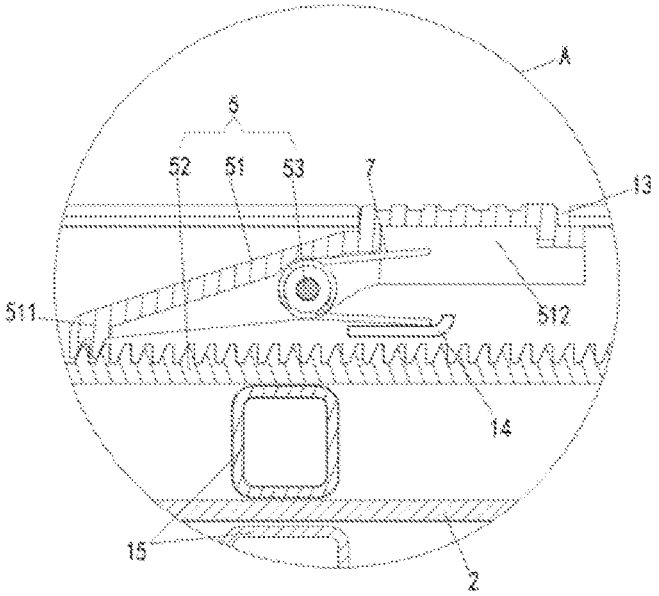
FIG. 3 is an enlarged view showing the structure of portion A of the present disclosure.
Figure 4:
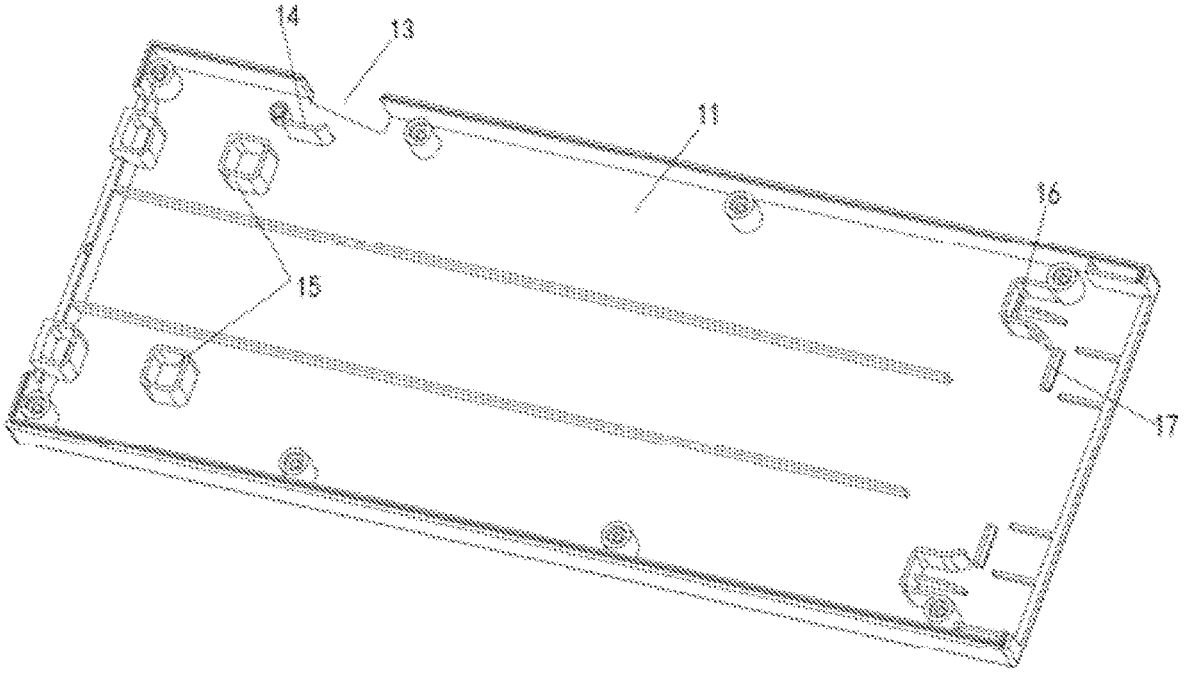
FIG. 4 is a schematic structural diagram of the first housing of the present disclosure.
Figure 5:
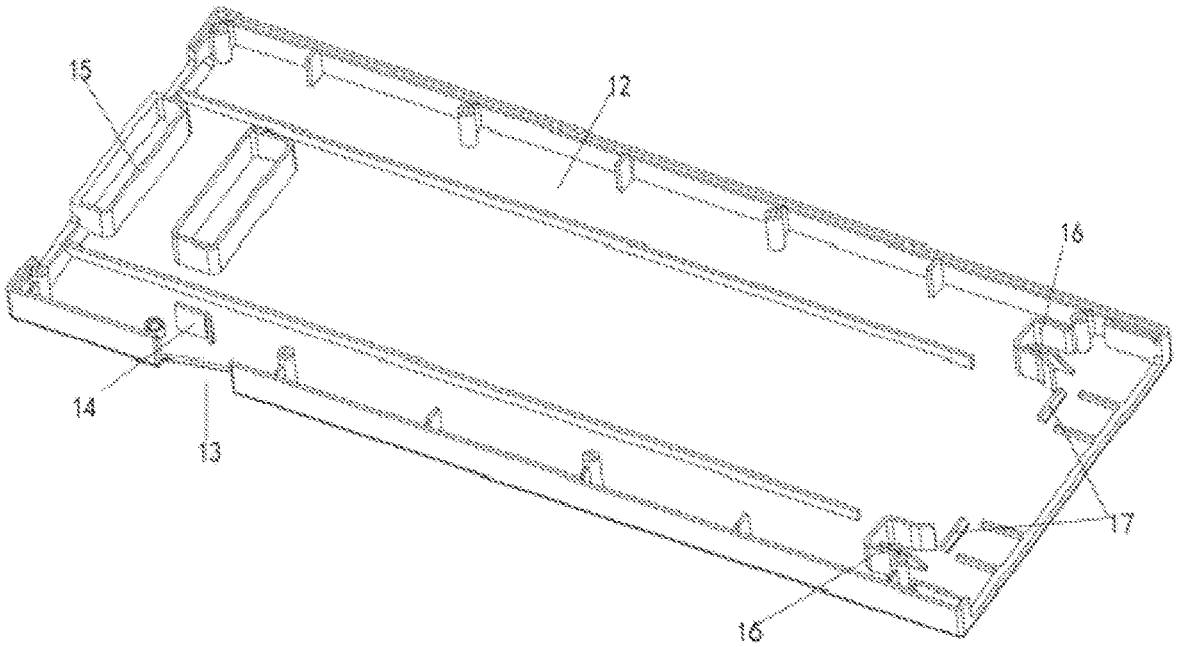
FIG. 5 is a schematic structural diagram of the second housing of the present disclosure.
Figure 6:
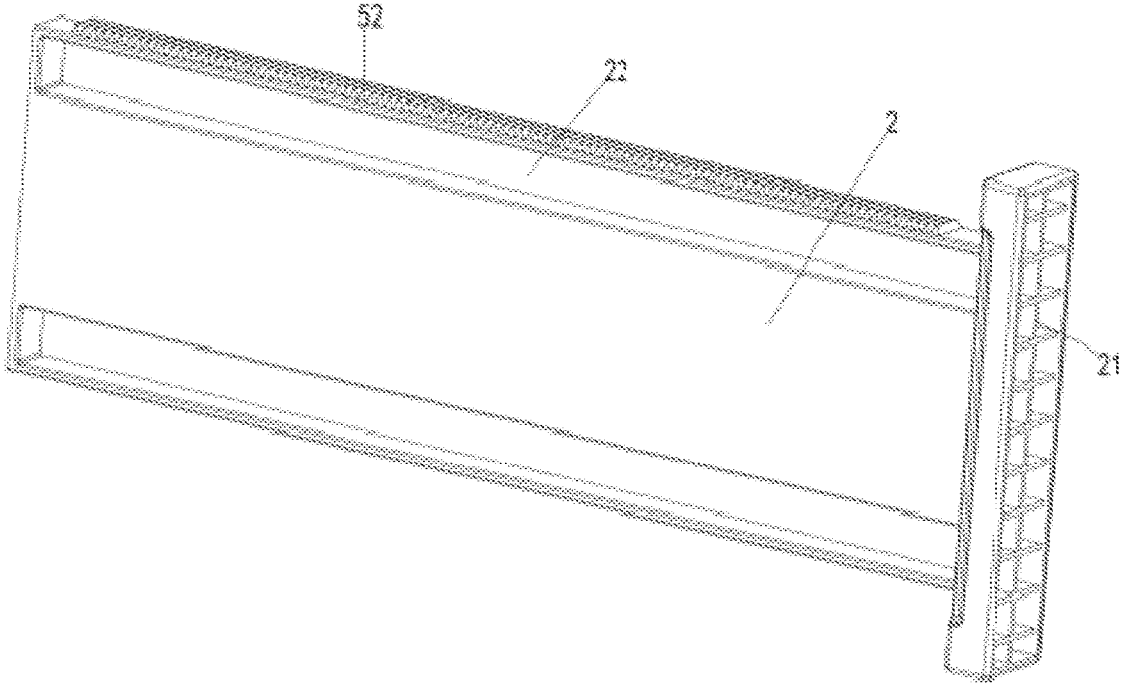
FIG. 6 is a first schematic structural diagram of the movable plate of the present disclosure.
Figure 7:
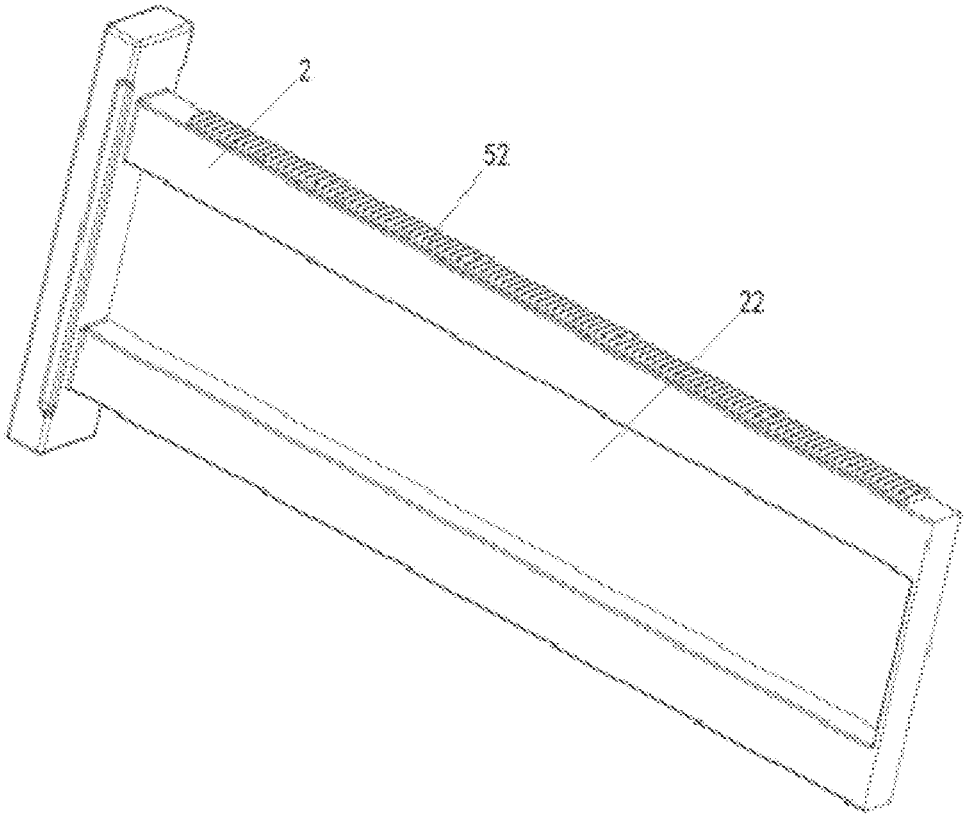
FIG. 7 is a second schematic structural diagram of the movable plate of the present disclosure.

Referring to FIGS. 1-3, the stopper mechanism 5 is provided between the dividing body 1 and the movable plate 2 to limit the relative sliding of the two; the buffer mechanism 3 is provided at the contact end of the dividing body 1 and configured to cushion the movement of the dividing body 1 along its retractable direction.

Specifically, the stopper mechanism 5 includes a locking member 51 and a limiting structure 52. The locking member 51 is hinged in the retractable chamber 6 through a rotating shaft 53, and the limiting structure 52 is provided on the movable plate 2 along the length direction of the movable plate 2. The locking member 51 is configured to cooperate with the limiting structure 52 to stop the movable plate 2.

The drawer dividing device limits and stops the movable plate 2 through the stopper mechanism 5 composed of the locking member 51 and the limiting structure 52. When the dividing body 1 and the movable plate 2 move toward each other and reach a predetermined position, the stopper mechanism 5 plays a role in limiting the relative movement of the two. Specifically, the stopper mechanism 5 is used to limit the relative sliding between the dividing body 1 and the movable plate 2, and the locking member 51 cooperates with the limiting structure 52 to limit the lateral movement of the movable plate 2.

Referring to FIG. 3, the limiting structure 52 is a rack provided on one side of the movable plate 2 along the length direction of the movable plate 2. The locking member 51 is hinged in the retractable chamber 6 through the rotating shaft 53 and located on the same side of the movable plate 2 where the rack is provided. One end of the locking member 51 is provided with a locking block 511 that matches the rack, and the other end of the locking member 51 extends in a direction close to the side wall of the dividing body 1 and is provided with a pressing block 512. The dividing body 1 is provided with a window 13 at a position corresponding to the pressing block 512 for exposing the pressing block 512. The engagement between the locking block 511 and the rack can limit the lateral movement of the movable plate 2, thus preventing the relative sliding between the dividing body 1 and the movable plate 2.

When the length of the drawer dividing device needs to be adjusted, an operator presses the pressing block 512 into the retractable chamber 6 to separate the locking block 511 from the rack, thereby releasing the locking of the stopper mechanism 5 on the movable plate 2. When the dividing body 1 and the movable plate 2 move toward each other and each a predetermined position, the contact ends of the dividing body 1 and the movable plate 2 abut against the inner wall of the drawer, and the operator releases the pressing block 512, so that the locking member 51 rotates under the elastic force of a retainer 7 to enable the locking block 511 of the locking member 51 to be engaged with the tooth of the rack. Since the teeth of the rack tilt toward the contact end of the movable plate 2, the dividing body 1 and the movable plate 2 move toward two ends of the drawer dividing device, respectively, such that an increased force is applied to the inner wall of the drawer by the contact ends of the dividing body 1 and the movable plate 2, thereby increasing the friction between the contact ends of the drawer dividing device and the inner wall of the drawer, and avoiding loose contact between the contact ends of the drawer dividing device and the inner wall of the drawer.

In the present solution, the limiting structure 52 is a zigzag rack, and the cross section of each tooth of the rack along its length direction is a right-angled triangle.

Referring to FIG. 3, the other end of the locking member 51 is provided with the pressing block 512. The pressing block 512 extends into the window 13 provided on the dividing body 1 and is aligned and matched with the window 13. The side of the pressing block 512 away from the retractable chamber 6 is provided with an anti-slip groove, and when the pressing block 512 is pressed, the anti-slip groove avoids the occurrence of slipping of an operator's finger during pressing.

In addition, the side of the pressing block 512 adjacent to the retractable chamber 6 is provided with the retainer 7 capable of elastic deformation. The retainer 7 is used to cooperate with the dividing body 1 to complete the locking operation. Specifically, the retainer 7 is a torsion spring. The torsion spring is coaxially arranged with the rotating shaft 53, one end of the torsion spring abuts against the pressing block 512, and the other end of the torsion spring abuts against the first baffle 14 that is arranged inside the retractable chamber 6. The first baffle 14 is L-shaped.

The pressing block 512 is driven to insert into the window 13 by the elastic force of the torsion spring. The torsion spring cooperates with the dividing body 1 to constrain the locking member 51. The pressing block 512 is blocked and limited by the window 13, so that the locking member 51 cannot rotate. Therefore, the cooperation between the dividing body 1 and the retainer 7 can stop the locking member 51.

Referring to FIG. 2, the buffer mechanism 3 includes a sliding member 31, a buffer pad 4, and an elastic member 32. One end of the sliding member 31 extends from the side of the dividing body 1 away from the movable plate 2 into the retractable chamber 6 and slidably fits with the retractable chamber 6. The elastic member 32 is provided at the end of the sliding member 31 adjacent to the retractable chamber 6, and the elastic member 32 is used to cushion the sliding member 31. The buffer pad 4 is provided at the end of the sliding member 31 away from the retractable chamber 6.

At the same time, the end of the sliding member 31 adjacent to the retractable chamber 6 is provided with a hook block 33 which is matched with the limiting block 17 arranged inside the retractable chamber 6. The cooperation between the hook block 33 and the limiting block 17 allows the sliding member 31 to move always within the retractable chamber 6.

Specifically, the elastic member 32 is a spring. Two springs are respectively provided on both sides of the end of the sliding member 31 adjacent to the retractable chamber 6. One end of the spring abuts against the sliding member 31, and the other end of the spring abuts against the second baffle 16 that is arranged inside the retractable chamber 6. The second baffle 16 is U-shaped. The cooperation between the second baffle 16 and the sliding member 31 ensures that the spring is always constrained and fixed within the retractable chamber 6. The second baffle 16 is used to limit the spring.

The sliding member 31 moves under the action of the elastic deformation of the elastic member 32. The elastic force of the spring ensures that an increased force is applied to the inner wall of the drawer by the contact ends of the dividing body 1 and the movable plate 2, thereby increasing the friction between the contact ends of the drawer dividing device and the inner wall of the drawer, and avoiding loose contact between the contact ends of the drawer dividing device and the inner wall of the drawer.

Meanwhile, the buffer mechanism 3 also plays a buffering role, preventing the dividing body 1 and the movable plate 2 from being bent due to excessive large force applied on the inner wall of the drawer.

The drawer dividing device of the present solution is composed of the dividing body 1 and the movable plate 2. The dividing body 1 and the movable plate 2 can slide relative to each other, and their lengths can be changed, thus being suitable for drawers of various sizes and structures. The stopper mechanism 5 plays a limiting role in preventing the relative sliding between the dividing body 1 and the movable plate 2. The buffer mechanism 3 effectively prevents the dividing body 1 and the movable plate 2 from being bent due to excessive large force applied on the inner wall of the drawer. The buffer pad 4 is in frictional contact with the inner wall of the drawer, leading to good connection stability and high reliability. Moreover, the connection stability will not be reduced after repeated connection, and the service life is long.

To sum up, the present disclosure provides a retractable drawer dividing device, which is used for partitioning the internal space of drawers and cabinets to increase the internal storage space, and overcomes the shortcomings that the existing drawer dividing device is non-retractable or unsmoothly retractable or cannot be firmly fixed after being stretched. As a result, the drawer dividing device can be freely stretched and retracted for fixation within the limit length. The stretching and retracting process is smooth, and the operation for fixation is simple, thus facilitating operations and improving user experience.

The above embodiments are only used to illustrate the technical solutions of the present disclosure, but not to limit it. Although the present disclosure has been described in detail with reference to the foregoing embodiments, those of ordinary skill in the art should understand that they can still make modifications to the technical solutions recited in the foregoing embodiments or conduct equivalent substitutions of some technical features. These modifications or substitutions do not cause the essence of the corresponding technical solutions to deviate from the spirit and scope of the technical solutions of the embodiments of the present disclosure.

What is claimed is:

1. A retractable drawer dividing device, comprising a dividing body and a movable plate; wherein the dividing body is a rectangular shell and internally provided with a retractable chamber extending to both ends along a length direction of the dividing body, one end of the movable plate is slidably inserted into the retractable chamber from one end of the dividing body; a stopper mechanism is provided between the dividing body and the movable plate for limiting the sliding of the movable plate in the retractable chamber; a buffer mechanism is provided at the other end of the dividing body and configured to cushion a force applied on an inner wall of an installation site by the dividing body during an installation;

the buffer mechanism comprises a sliding member, a buffer pad, and an elastic member, one end of the sliding member is slidably inserted into the retractable chamber from the side of the dividing body away from the movable plate; the elastic member is provided at the end of the sliding member adjacent to the retractable chamber, and the elastic member is used to cushion the sliding member; the buffer pad is provided on the side of the sliding member away from the retractable chamber; and the side of the sliding member adjacent to the retractable chamber is provided with a hook block which is matched with a limiting block arranged inside the retractable chamber; the cooperation between the hook block and the limiting block allows the sliding member to move always within the retractable chamber.

2. The retractable drawer dividing device according to claim 1, wherein the stopper mechanism comprises a locking member and a limiting structure; the limiting structure is provided on the movable plate along a length direction of the movable plate; the locking member is hinged in the retractable chamber and configured to cooperate with the limiting structure to stop the movable plate;

the locking member and the limiting structure have a first state in which the locking member and the limiting structure cooperate with each other to lock the movable plate and a second state in which the locking member is separated from the limiting structure to unlock the movable plate.

3. The retractable drawer dividing device according to claim 2, wherein the limiting structure is a rack provided on one side of the movable plate along the length direction of the movable plate; the locking member is hinged in the retractable chamber through a rotating shaft and located on the same side of the movable plate where the rack is provided;

one end of the locking member is provided with a locking block that matches the rack, and the other end of the locking member extends in a direction close to the side wall of the dividing body and is provided with a pressing block, the dividing body is provided with a window at a position corresponding to the pressing block for exposing the pressing block.

4. The retractable drawer dividing device according to claim 3, wherein the side of the pressing block adjacent to the retractable chamber is provided with a retainer capable of elastic deformation, the retainer is connected to the dividing body and used to facilitate the cooperation between the locking block and the rack to maintain the movable plate in the first state, and meanwhile, the retainer deforms by pressing the pressing block, so that the locking block is separated from the rack to switch the movable plate from the first state to the second state.

5. The retractable drawer dividing device according to claim 4, wherein the retainer is a torsion spring, the torsion spring is coaxially arranged with the rotating shaft; one end of the torsion spring abuts against the pressing block, and the other end of the torsion spring abuts against a first baffle arranged inside the retractable chamber.

6. The retractable drawer dividing device according to claim 1, wherein the elastic member is a spring, and the number of the spring is two; the two springs are respectively provided at both ends of the side of the sliding member adjacent to the retractable chamber, one end of the spring abuts against the sliding member, and the other end of the spring abuts against a baffle of the buffer mechanism arranged inside the retractable chamber.

7. The retractable drawer dividing device according to claim 1, wherein the other end of the movable plate is provided with a buffer pad.

8. The retractable drawer dividing device according to claim 1, wherein the dividing body comprises a first housing and a second housing that are matched with and connected to each other; the first housing and the second housing are enclosed to form the retractable chamber; opposite sides of the first housing and the second housing are provided with guide blocks, respectively, the movable plate is provided with guide grooves at positions corresponding to the guide blocks, and the guide grooves are configured to cooperate with the guide blocks to guide the movable plate to slide along the length direction of the dividing body.

* * * * *